US007479038B2

(12) United States Patent
Weng

(10) Patent No.: US 7,479,038 B2
(45) Date of Patent: Jan. 20, 2009

(54) LAMP BASE WITH IMPROVED STRUCTURE OF ELECTRIC CONDUCTION

(76) Inventor: Yunlei Weng, Room 601, No. 24 Hexiang East Road, Xiamen, Fujian 361000 (CN)

( * ) Notice: Subject to any disclaimer, the term of this patent is extended or adjusted under 35 U.S.C. 154(b) by 61 days.

(21) Appl. No.: 11/711,507

(22) Filed: Feb. 27, 2007

(65) Prior Publication Data

US 2007/0290598 A1 Dec. 20, 2007

(30) Foreign Application Priority Data

Jun. 15, 2006 (CN) ..... 2006 2 0085720 U

(51) Int. Cl.
*H01K 1/00* (2006.01)

(52) U.S. Cl. ..... 439/615

(58) Field of Classification Search ..... 439/615, 439/611, 613, 665; 313/317, 318.01
See application file for complete search history.

(56) References Cited

U.S. PATENT DOCUMENTS 5,382,869 A * 1/1995 Williamson et al. .... 313/318.01
5,568,009 A * 10/1996 Gandhi ..... 313/318.01
6,653,770 B1 * 11/2003 Matsuba et al. ..... 313/318.04
6,734,633 B2 * 5/2004 Matsuba et al. ..... 315/58
6,922,009 B2 * 7/2005 Plawski et al. ..... 313/318.01
7,375,456 B2 * 5/2008 Collins et al. ..... 313/25

* cited by examiner

*Primary Examiner*—Phuong K Dinh
(74) *Attorney, Agent, or Firm*—Greer, Burns & Crain, Ltd.

(57) ABSTRACT

A lamp base including an insulating shell connected to a luminous tube; an electric cap which electrically connects with a live voltage source; a T-shaped plastic connecting piece of the electric cap; an electric piece which electrically connects with a neutral power source wire, a basal body of the electric piece is an annular conducting strip which forms metal fixed claws extending into the insulating shell; a first lead disposed in the insulating shell; the electric cap inserts fixedly into a T-shaped plastic connecting piece and is disposed at the top of the insulating shell; the annular conducting strip covers the T-shaped plastic connecting piece; the metal fixed claws of the electric piece extend into the insulating shell, the electric cap and the annular conducting strip being disposed outside of the insulating shell; the electric cap is insulated with the annular conducting strip by the T-shaped plastic connecting piece.

9 Claims, 7 Drawing Sheets

LAMP BASE WITH IMPROVED STRUCTURE OF ELECTRIC CONDUCTION

BACKGROUND OF THE INVENTION

The present invention relates to a lamp base, more particularly to a lamp base with improved structure of electric conduction.

Conventional lamp bases comprise an insulating shell, an electric cap electrically connecting with the first electrode of external power, an electric shell electrically connecting with the second electrode of external power, a first lead and a second lead disposing in the insulating shell; the electric cap connecting fixedly with the top of the insulating shell; the electric shell fixedly covers the insulating shell and connecting with lamp holder; the first lead electrically connects with the electric cap and one electrode of commutation electrocircuit of lamp base or lamp base, the second lead electrically connects with the electric shell and another electrode of commutation electrocircuit of lamp base or lamp base. The electric shell of the lamp base is threaded. The threaded shell is usually made of copper, which is costly and uses much copper. Also, the copper shell is difficult to machine, and has a high production cost because of the rise of the copper price. Chinese patent No. CN2321139 is entitled "A thread lamp base of contact current", and dicloses a threaded shell and a top contact piece of live wire; the threaded shell is made by fireretardant insulation material; a groove disposes at the thread shell; a metal contact piece of neutral wire is embedded in the groove. Wherein, the electric shell is replaced by the metal contact piece of neutral wire, which can reduce the dosage of metal and production cost, but it has two disadvantages: firstly, it cannot always assure the contact of the contact piece and neutral, which debases the electric contact stability of the contact piece and neutral wire secondly, it is inconvenient to fixedly connect the contact piece with the shell, and the connection of them has a lower intensity and is easy to break off.

BRIEF SUMMARY OF THE INVENTION

The present invention is to solve the problem of existing technology, to provide a lamp base with improved structure of electric conduction, which can assure the electric connecting of the lamp base and external power and reduce the dosage of metal and production cost.

The present invention adopts the technical proposal as follows: a lamp base with improved structure of electric conduction, comprising an insulating shell connecting with a luminous tube;

an electric cap which electrically connects with the live wire of external power;

a T-shape plastic connecting piece of the electric cap;

an electric piece which electrically connects with the neutral wire of external power, the basal body of the electric piece is annular conducting strip which forms metal fixed claws extending into the insulating shell;

a first lead disposes in the insulating shell; the electric cap inserts fixedly into the T-shape plastic connecting piece and disposes at the top of the insulating shell; the annular conducting strip covers the T-shape plastic connecting piece; the metal fixed claws of the electric piece extend into the insulating shell, the electric cap and the annular conducting strip dispose outside of the insulating shell; the electric cap is insulated with the annular conducting strip by T-shape plastic connecting piece; the first lead electrically connects with the electric cap and one electrode of commutation electrocircuit of lamp base or lamp base, the electric piece electrically connects with another electrode of commutation electrocircuit of lamp base or lamp base.

Said electric cap includes connector pins, the T-shape plastic connecting piece includes sockets to accept the connector pins, the electric cap connects fixedly with the connecting piece with metal burrs and elasticity of the connector pins and the sockets.

A stator disposes between the electric piece and the T-shape plastic connecting piece, the stator is an annular metal elasticity piece which comprises fixed claws; the electric piece connects fixedly with the T-shape plastic connecting piece through pressing the fixed claws of the stator into the T-shape plastic connecting piece.

The present invention also can adopt the technical proposal as follows: a lamp base with improved structure of electric conduction, comprising an insulating shell which can connect with luminous tube, comprising integrative upside, downside and annulus connecting the upside with the downside;

an electric cap electrically connecting with the live wire of external power;

an electric piece electrically connecting with the neutral wire of external power, the electric piece is annular conducting strip which forms metal fixed claws extending into the insulating shell;

a first lead disposes in the insulating shell; the electric cap inserts fixedly into the top of the upside, the annular conducting strip covers the upside and connects fixedly with the annulus; the metal fixed claws of the electric piece extend into the insulating shell, the electric cap and the annular conducting strip dispose outside of the insulating shell; the electric cap is insulated with the annular conducting strip by the upside; the first lead electrically connects with the electric cap and one electrode of commutation electrocircuit of lamp base or lamp base, the electric piece electrically connects with another electrode of commutation electrocircuit of lamp base or lamp base.

Said electric cap includes connector pins; said upside is T-shape plastic connecting piece, the T-shape plastic connecting piece includes sockets to accept the connector pins, the electric cap connects fixedly with the connecting piece with metal burrs and elasticity.

Said metal fixed claws dispose in the underside of the annular conducting strip, the annulus includes sockets to accept the metal fixed claws; the metal fixed claws insert into the sockets and extend into the insulating shell.

Said metal fixed claw is elongation piece of outer edge bottom of annular conducting strip extending downwards; the downside of the insulating shell forms an orientation groove whose underside forms a punch hole through the inside and outside of the insulating shell; the metal fixed claws dispose in the orientation groove and come out of the outer edge of the downside, and the metal fixed claws drill through the punch hole and extend into the insulating shell.

A second lead which disposes in the insulating shell, the second lead electrically connects with the electric piece and another electrode of commutation electrocircuit of lamp base or lam base.

Said electric cap inosculates fixedly with the top of the upside; the annular conducting strip inosculates fixedly with the surface of annulus.

The present invention has virtues as follows comparing with the existing technology: the lamp base and the electric piece assure the electric connecting of the lamp base and external power and reduce the dosage of metal and production cost; the basal body of the electric piece is annular conducting strip, which can connect fixedly with the insulating shell and is easy to connect; the annular conducting strip connects fixedly with the top surface of the annulus, which can assure the electric connecting of the lamp base and external power; the electric cap inosculates fixedly with the top of the upside, the annular conducting strip inosculates fixedly with the surface of annulus, it is easy to machining the lamp base; the metal fixed claws fixedly insert into the socket, which make the connection of the electric piece and the insulating shell easily and hard, and the second lead can be easy to electrically connect with the metal fixed claws; the elongation piece of annular conducting strip has a lower dosage of copper comparing with conventional copper screw thread.

DETAILED DESCRIPTION OF THE PREFERRED EMBODIMENTS

Embodiment One

Figure 1:
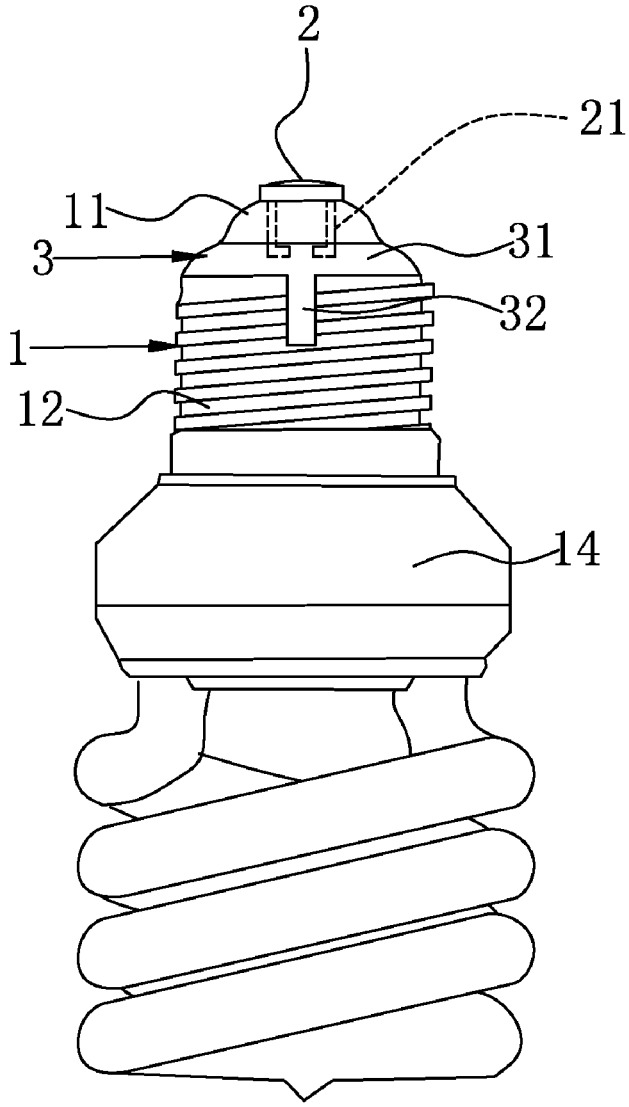
FIG. 1 is the sketch map of conformation of the energy-saving lamp in embodiment one.
Figure 2:
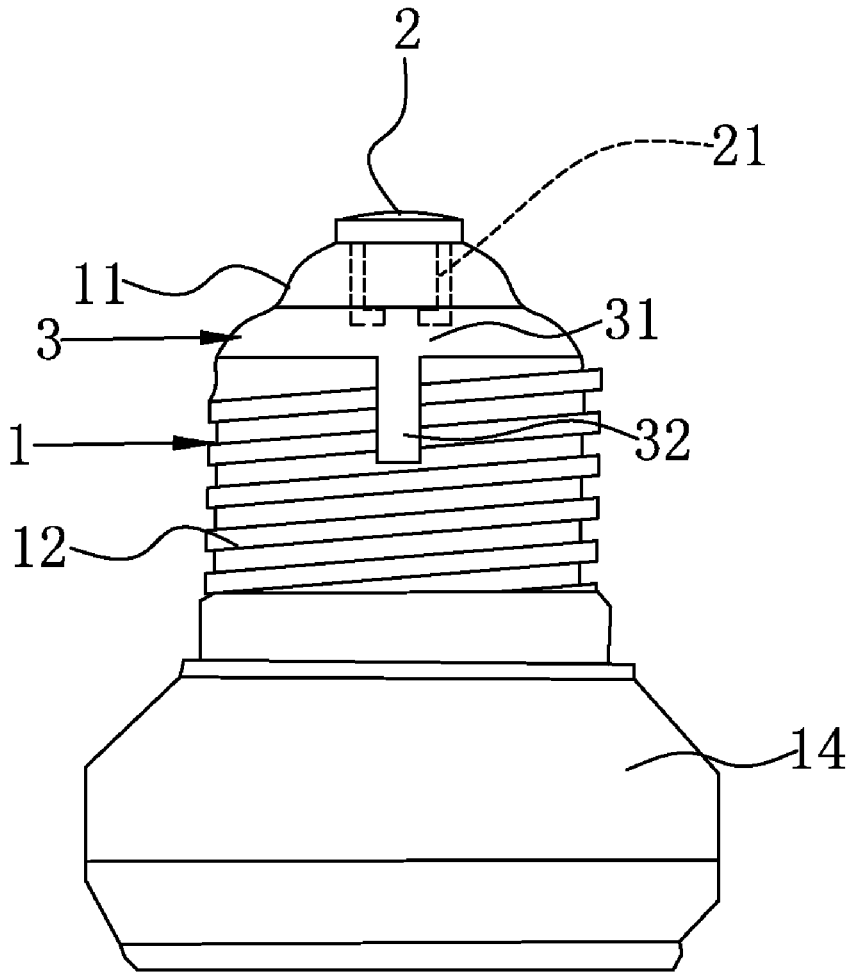
FIG. 2 is the front view of the lamp base in embodiment one.
Figure 3:
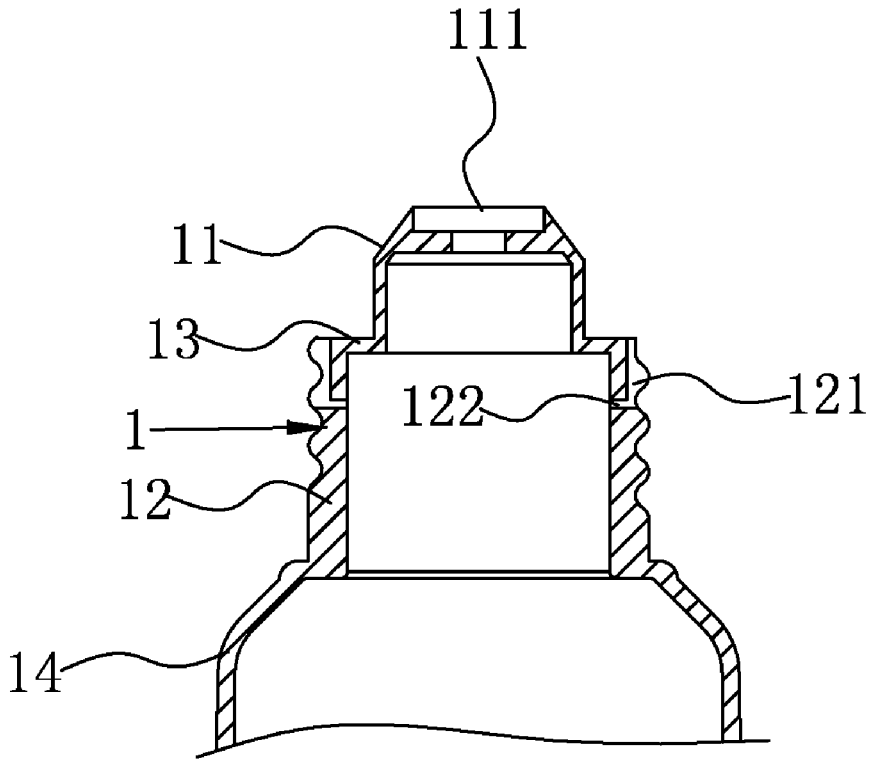
FIG. 3 is the sketch map of part section of the insulating shell in embodiment one.

A lamp base of improved energy-saving lamp, referring to FIGS. 1 to 3, comprising an insulating shell 1, an electric cap 2, an electric piece 3, a first lead and a second lead.

The lamp base is designed for use with an energy-saving lamp, but it is not limited to the lamp base of energy-saving lamp, others such as incandescent lamps also are the contemplated for use with the present invention.

As FIGS. 1 and 3, the insulating shell 1 comprises an upside 11, a downside 12 and an annulus 13 connecting the upside 11 with the downside 12; the upside 11 is a T-shaped connecting piece, with the "T" defined by elements 31 and 32 (FIG. 1); the outer circumference of the downside 12 forms external thread so that the downside 12 can be threaded with the lamp holder of external power. Thereinto, a socket 111 disposes at the upside 11; an orientation groove 121 disposes at the outer circumference of the downside 12, a punch hole 122 through the inside and outside of the insulating shell locates at the underside of the orientation groove 121. The plastic lamp shell 14 connects fixedly with the downside 12.

The electric cap 2 includes connector pins 21 (shown hidden in FIGS. 1 and 2), the connector pins insert into the socket 111 so that the electric cap 2 connects fixedly with the T-shape connecting piece with metal burrs and elasticity of the connector pins. The electric cap 2 can dovetail into the socket 111 of the upside 11, and the electric cap 2 protrudes outside of the top of the upside 11 so that the electric cap can electrically connect with the live wire of external power. A first lead disposes in the insulating shell and can electrically connect with the electric cap 2 and one electrode of commutation electrocircuit of lamp base or lamp base.

The basal body of the electric piece 3 is annular conducting strip 31 which cooperates with the top surface of the annulus 13. The annular conducting strip 31 covers the upside 11 and connects fixedly with the annulus 13. The electric piece 3 also comprises several elongation pieces 32 which connect fixedly with the outer edge bottom of annular conducting piece 31. The elongation pieces 32 dispose in the orientation groove 121 and protrude outside of the screw thread of the downside 12 in some sort. The end of the elongation pieces 32 drill through the punch hole 122 and extend into the insulating shell 1. The elongation pieces 32 are metal fixed claws. The electric piece 3 disposes at the top surface of the insulating shell 1 so that the electric piece 3 can electrically connect with neutral wire of external power. A second lead which disposes in the insulating shell, the second lead electrically connects with the electric piece 3 and another electrode of commutation electrocircuit of lamp base or lamp base.

The electric cap 2 and the electric piece 3 is insulated by the upside 11.

Embodiment Two

Figure 4:
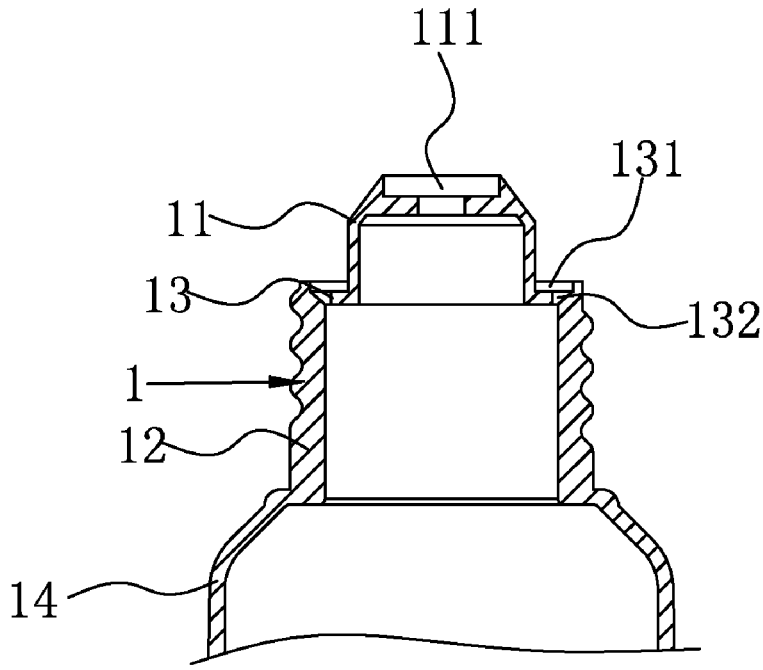
FIG. 4 is the sketch map of part section of the insulating shell in embodiment two.

The difference of this embodiment with embodiment one is: as FIG. 4, groove 131 disposes at the top surface of the annulus 13, several sockets 132 through the annulus 13 locate at the underside of the groove 131. Several metal fixed claws dispose at the underside of the annular conducting strip 31 but without elongation pieces 32. Thereinto, annular conducting strip 31 locates in the groove 131 and the metal fixed claws insert into the sockets 132 and extend into the insulating shell. The second lead electrically connects with the metal fixed claws of the electric piece.

Embodiment Three

Figure 5:
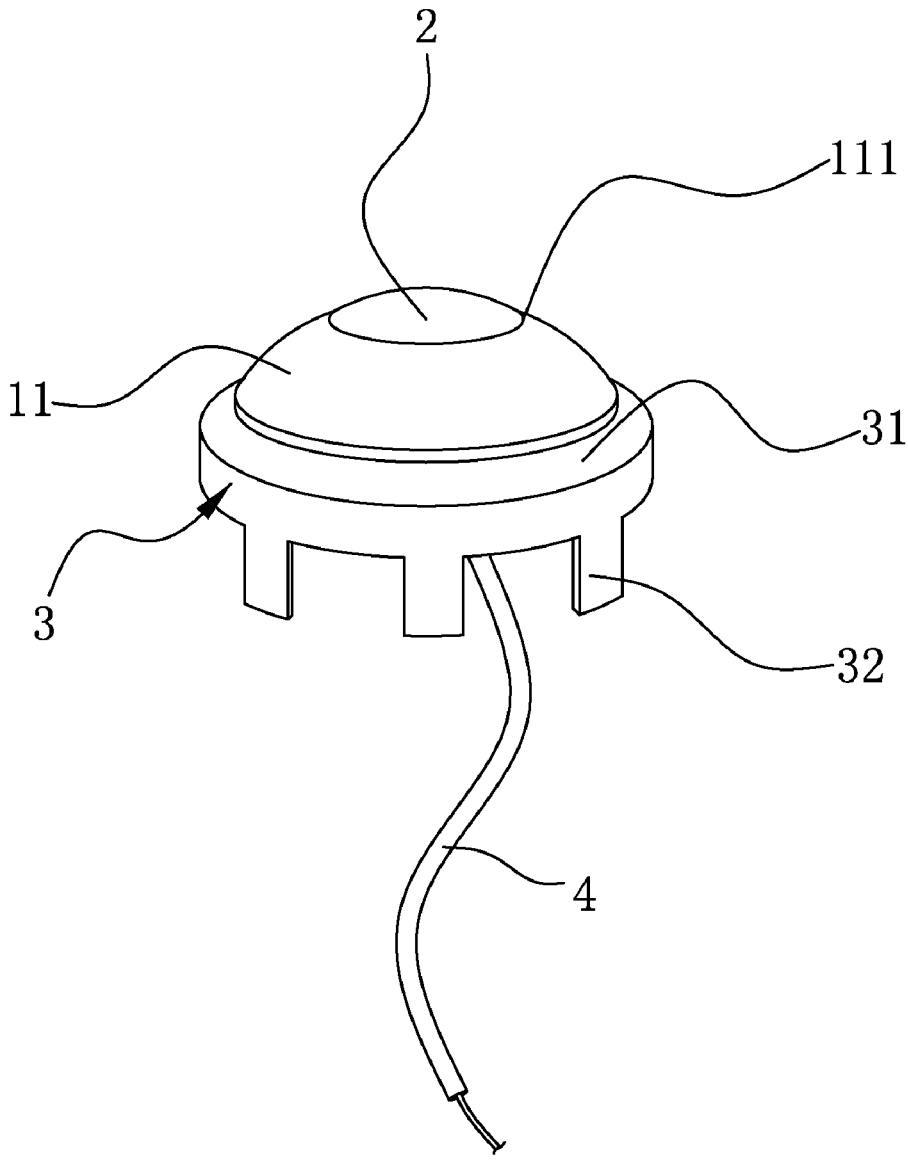
FIG. 5 is the sketch map of the three dimensional structure of the electric map, connecting piece, electric piece and the first lead in embodiment three.
Figure 6:
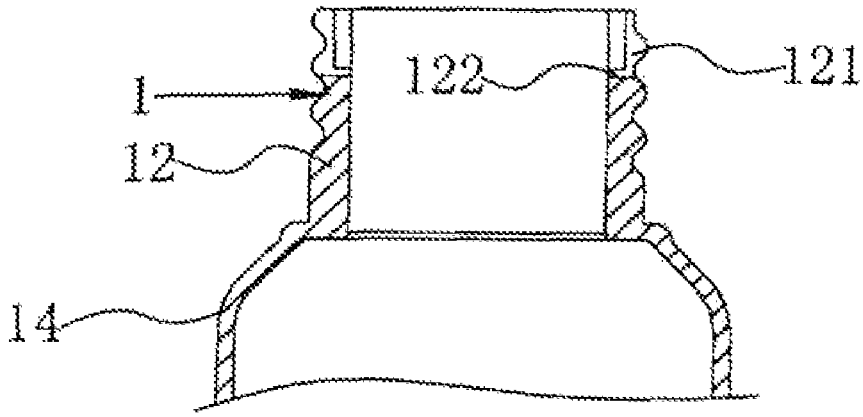
FIG. 6 is the sketch map of part section of the downside in embodiment three.
Figure 7:
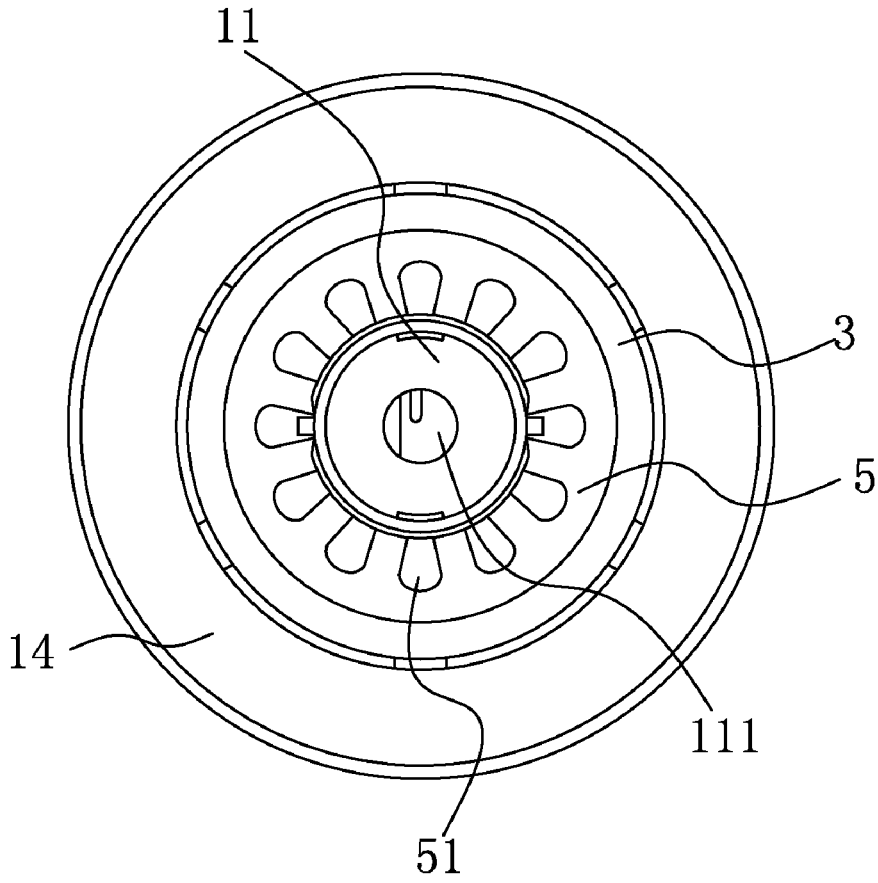
FIG. 7 is the planform of the lamp base in embodiment three.

The difference of this embodiment with embodiment one is: as FIGS. 5 to 7, a lamp base with improved structure of electric conduction, comprising an insulating shell 1, an electric cap 2, a T-shape plastic connecting piece 11 of the electric cap, an electric piece 3, a first lead 4 and a second lead.

Sockets 111 dispose at the T-shape plastic connecting piece 11. The insulating shell 1 comprises the downside 12, an orientation groove 121 disposes at the outer edge of the downside 12, a punch hole 122 through the outside and inside of insulating shell disposes at the downside of the orientation groove 121. The plastic lamp shell 14 connects fixedly with the downside 12.

The electric cap 2 includes connector pins 21 the electric cap inserts into the socket 111 so that the electric cap 2 connects fixedly with the T-shape connecting piece with metal burrs and elasticity of the connector pins. The electric cap can dovetail into the socket 111 of the upside 11, and the electric cap 2 protrudes outside of the top of the upside 11 so that the electric cap 2 can electrically connect with the live wire of external power. A first lead disposes in the insulating shell 1 and can electrically connect with the electric cap 2 and one electrode of commutation electrocircuit of lamp base or lamp base.

The basal body of the electric piece 3 is annular conducting strip 31, a stator 5 disposes between the electric piece 3 and the T-shape plastic piece 11. The stator 5 is annular metal elasticity piece which comprises fixed claws 51, the electric piece 3 connects fixedly with the T-shape plastic connecting piece through pressing the fixed claws 51 of the stator 5 into the T-shape plastic connecting piece 11. The electric piece 31 also comprises several metal fixed claws 32 which connects fixedly with the annular conducting strip. The annular conducting strip 31 covers the upside 11; the metal fixed claws 32 dispose in the orientation groove 121 and protrude outside of the screw thread of the downside 12 in some sort. The end of the metal fixed claws 32 drill through the punch hole 122 and extend into the insulating shell 1. The electric piece 3 disposes at the exterior of the insulating shell 1 so that the electric piece 3 can electrically connect with neutral wire of external power. A second lead which disposes in the insulating shell, the second lead electrically connects with the electric piece 3 and another electrode of commutation electrocircuit of lamp base or lam base.

The electric cap 2 and the electric 3 is insulated by the T-shape plastic connecting piece 11.

While the present invention has been described in connection with what is considered the most practical and preferred embodiment, it is understood that present invention is not limited to the disclosed embodiment but is intended to cover various arrangements included within the spirit and scope of the broadest interpretation so as to encompass all such modifications and equivalent arrangements.

The invention claimed is:

1. A lamp base with improved structure of electric conduction, comprising:

an insulating shell connecting with a luminous tube;

an electric cap which electrically connects with the live wire of external power;

a T-shape plastic connecting piece of the electric cap;

an electric piece which electrically connects with a neutral wire of external power, a basal body of the electric piece is an annular conducting strip which forms metal fixed claws extending into the insulating shell; and a first lead disposes in the insulating shell; the electric cap inserts fixedly into the T-shape plastic connecting piece and disposes at the top of the insulating shell; the annular conducting strip covers the T-shape plastic connecting piece; the metal fixed claws of the electric piece extend into the insulating shell, the electric cap and the annular conducting strip dispose outside of the insulating shell; the electric cap is insulated with the annular conducting strip by T-shape plastic connecting piece; the first lead electrically connects with the electric cap and one electrode of commutation electrocircuit of a lamp base or a lamp base, the electric piece electrically connects with another electrode of commutation electrocircuit of the lamp base or the lamp base.

2. The lamp base with improved structure of electric conduction according to claim 1, wherein said electric cap includes connector pins, the T-shape plastic connecting piece includes sockets to accept the connector pins, the electric cap connects fixedly with the connecting piece with metal burrs and elasticity of the connector pins and the sockets.

3. The lamp base with improved structure of electric conduction according to claim 1, wherein a stator disposes between the electric piece and the T-shape plastic connecting piece, the stator is an annular metal elasticity piece which comprises fixed claws; the electric piece connects fixedly with the T-shape plastic connecting piece through pressing the fixed claws of the stator into the T-shape plastic connecting piece.

4. A lamp base with improved structure of electric conduction, comprising:

an insulating shell which can connect with a luminous tube, cormprising an integrative upside, downside and annulus connecting the upside with the downside;

an electric cap electrically connecting with the live wire of external power;

an electric piece electrically connecting with a neutral wire of external power, a basal body of the electric piece is annular conducting strip which forms metal fixed claws extending into the insulating shell; and a first lead disposes in the insulating shell; the electric cap inserts fixedly into the top of the upside, the annular conducting strip covers the upside and connects fixedly with the annulus; the metal fixed claws of the electric piece extend into the insulating shell, the electric cap and the annular conducting strip dispose outside of the insulating shell; the electric cap is insulated with the annular conducting strip by the upside; the first lead electrically connects with the electric cap and one electrode of commutation electrocircuit of a lamp base or a lamp base, the electric piece electrically connects with another electrode of commutation electrocircuit of the lamp base or the lamp base.

5. The lamp base with improved structure of electric conduction according to claim 4, wherein said electric cap includes connector pins; said upside is a T-shaped plastic connecting piece, the T-shaped plastic connecting piece includes sockets to accept the connector pins, the electric cap connects fixedly with the connecting piece with metal burrs and elasticity.

6. The lamp base with improved structure of electric conduction according to claim 4, wherein said metal fixed claws dispose in the underside of the annular conducting strip, the annulus includes sockets to accept the metal fixed claws; the metal fixed claws insert into the sockets and extend into the insulating shell.

7. The lamp base with improved structure of electric conduction according to claim 4, wherein said metal fixed claw is elongation piece of outer edge bottom of annular conducting strip extending downwards; the downside of the insulating shell forms an orientation groove whose underside forms a punch hole through the inside and outside of the insulating shell; the metal fixed claws dispose in the orientation groove and come out of the outer edge of the downside, and the metal fixed claws drill through the punch hole and extend into the insulating shell.

8. The lamp base with improved structure of electric conduction according to claim 4, also comprises a second lead which disposes in the insulating shell, the second lead electrically connects with the electric piece and another electrode of commutation electrocircuit of lamp base or lam base.

9. The lamp base with improved structure of electric conduction according to claim 4, wherein said electric cap inosculates fixedly with the top of the upside; the annular conducting strip inosculates fixedly with the surface of annulus.

* * * * *